US007263823B2

(12) United States Patent
Andrews et al.

(10) Patent No.: US 7,263,823 B2
(45) Date of Patent: Sep. 4, 2007

(54) SYSTEM FOR MEASURING NOX CONTENT OF EXHAUST GAS

(75) Inventors: Eric B. Andrews, Columbus, IN (US); Jeffrey M. Weikert, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 10/855,811

(22) Filed: May 27, 2004

(65) Prior Publication Data

US 2005/0262833 A1 Dec. 1, 2005

(51) Int. Cl.
*F01N 3/00* (2006.01)

(52) U.S. Cl. ..... 60/288; 60/274; 60/277; 60/287; 60/292; 60/297; 60/301; 73/118.1

(58) Field of Classification Search ..... 60/274, 60/276, 277, 285, 287, 288, 292, 297, 301; 73/118.1

See application file for complete search history.

(56) References Cited

U.S. PATENT DOCUMENTS 4,232,517 A 11/1980 Sumiyoshi et al.
5,596,975 A 1/1997 Thomas et al.
5,627,328 A 5/1997 Sheridan et al.
5,693,877 A * 12/1997 Ohsuga et al. ..... 73/118.1
5,948,963 A 9/1999 Kato et al.
6,105,365 A * 8/2000 Deeba et al. ..... 60/274
6,112,575 A 9/2000 Cocconi
6,173,568 B1 * 1/2001 Zurbig et al. ..... 60/274
6,196,053 B1 3/2001 Kato et al.
6,212,885 B1 4/2001 Herota et al.
6,442,998 B2 9/2002 Kurokawa et al.
6,568,179 B2 * 5/2003 Deeba ..... 60/298
6,598,470 B2 7/2003 Ludwig et al.
6,635,161 B2 10/2003 Inagaki
6,742,328 B2 * 6/2004 Webb et al. ..... 60/285
6,779,339 B1 * 8/2004 Laroo et al. ..... 60/297
6,820,417 B2 * 11/2004 May et al. ..... 60/297
2003/0115860 A1 6/2003 May et al.
2003/0121310 A1 7/2003 Tomura et al.

* cited by examiner

*Primary Examiner*—Binh Q. Tran
(74) *Attorney, Agent, or Firm*—Barnes & Thornburg LLP

(57) ABSTRACT

A system for measuring NOx content of an exhaust gas produced includes at least one controllable valve operable to direct exhaust gas to a NOx sensor only when measurement of the NOx content is desired and to otherwise expose the NOx sensor to ambient air. A control circuit controls the operation of the at least one valve and determines the NOx content of the exhaust gas based on sensory data received from the NOx sensor.

17 Claims, 3 Drawing Sheets

SYSTEM FOR MEASURING NOX CONTENT OF EXHAUST GAS

FIELD OF THE INVENTION

The present invention relates generally to exhaust systems for internal combustion engines, and more specifically to systems for measuring NOx content of exhaust gas produced by internal combustion engines.

BACKGROUND OF THE INVENTION

When combustion occurs in an environment with excess oxygen, peak combustion temperatures increase which leads to the formation of unwanted emissions, such as oxides of nitrogen (NOx). This may be aggravated in internal combustion engine applications through the use of turbocharger machinery operable to increase the mass of fresh air flow, and hence increase the concentrations of oxygen and nitrogen present in the combustion chamber of the engine when the temperature is high during or after the combustion event.

Conventional NOx reduction techniques may be implemented, such as including a NOx emissions filter in-line with the exhaust stream. With such techniques, it is typically useful to determine the NOx content of the exhaust gas exiting the engine.

The NOx content of the exhaust gas produced by the engine is may be or otherwise determined directly with a conventional NOx sensor. NOx sensors are well known in the art and commercially available. In typical applications, the NOx sensor is exposed to the exhaust gas to produce a signal indicative of the NOx content of the exhaust gas. However, after prolonged exposure to the exahust gas, NOx sensors have been known to degrade thereby affecting the long-term durability and reliability of the NOx sensor and, accordingly, the accuracy of the NOx content measurement.

SUMMARY OF THE INVENTION

The present invention may comprise one or more of the following features or combinations thereof. A system for measuring a NOx content of exhaust gas produced by an internal combustion engine includes a bypass conduit having a first end fluidly coupled to an exhaust pipe of the engine and a second end open to ambient air. A first valve positioned in-line with the bypass conduit and a NOx sensor fluidly coupled to the bypass conduit, the NOx sensor producing a NOx signal indicative of a NOx content of exhaust gas flowing thereby. The system also includes a control circuit controlling the first valve to an open position to allow exhaust gas to flow past the NOx sensor when measurement of the NOx content is desired, and otherwise controlling the valve to a closed position to inhibit exhaust gas flow past the NOx sensor.

An exhaust system of an internal combustion engine includes an exhaust pipe fluidly coupled to the engine and an emissions filter coupled in-line with the exhaust pipe. Additionally, a first NOx sensor arrangement is in fluid communication with the exhaust pipe and includes a NOx sensor and a first controllable valve movable between a closed position and an open position. The exhaust system also includes a control circuit configured to control the first valve between the closed position to inhibit a flow of exhaust gas from the engine to the NOx sensor and the open position to direct at least a portion of the flow of the exhaust gas to the NOx sensor.

A method of measuring a NOx content of exhaust gas produced by an internal combustion engine includes moving a first valve to an open position to allow exhaust gas to flow past a NOx sensor when measurement of the NOx content is desired and moving the first valve to a closed position to inhibit exhaust gas flow past the NOx sensor. The method further includes processing a data signal produced by the NOx sensor only when the first valve is in the open position to determine the NOx content of the exhaust gas.

A method of routing a flow of exhaust gas produced by an internal combustion engine to a NOx sensor includes controlling a first valve to an open position to direct at least a portion of the flow of exhaust gas to the NOx sensor and controlling the first valve to a closed position to inhibit the flow of exhaust gas to the NOx sensor.

These and other features of the present invention will become more apparent from the following description of the illustrative embodiments.

DESCRIPTION OF THE ILLUSTRATIVE EMBODIMENTS

Figure 1:
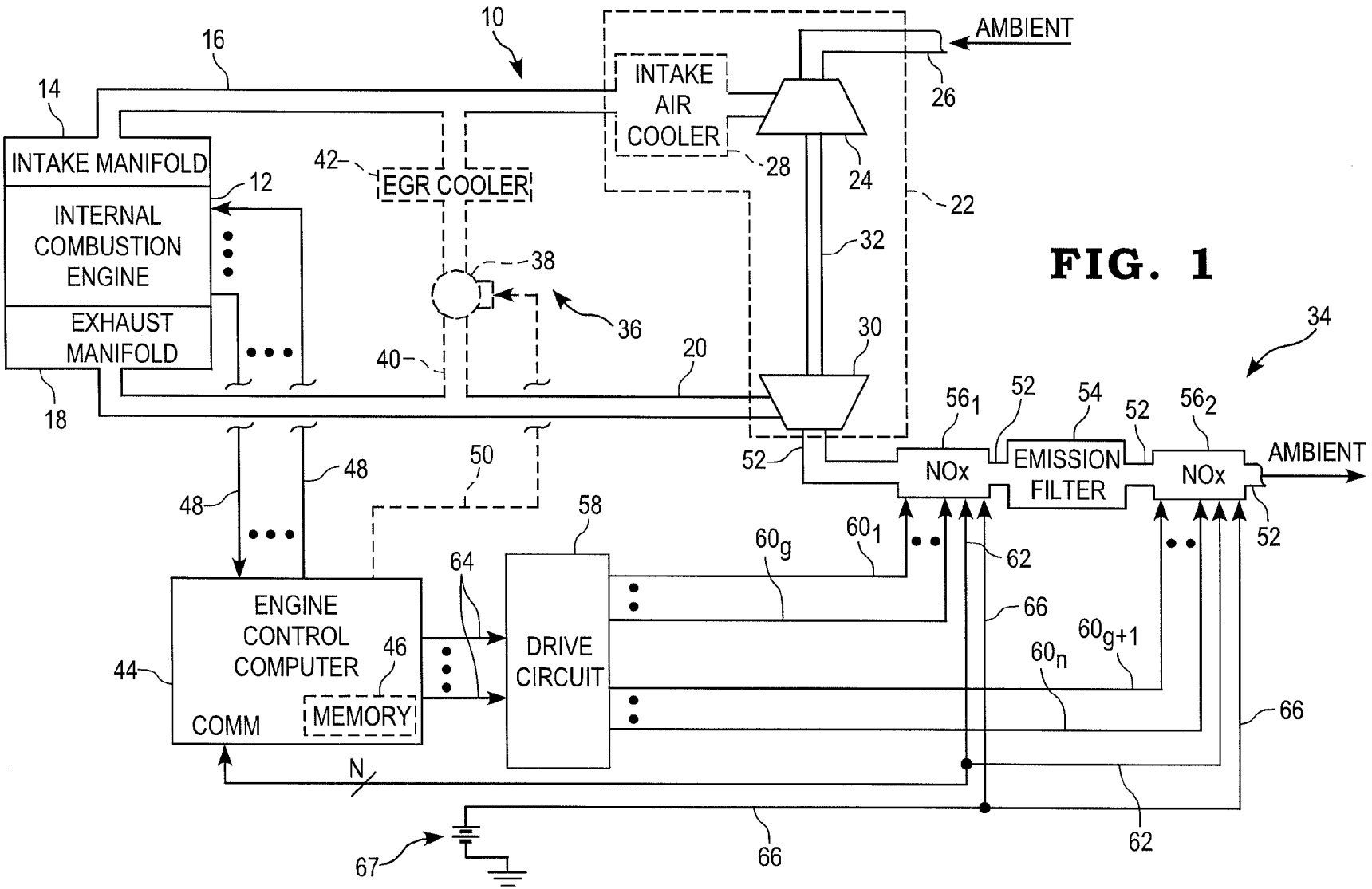
FIG. 1 is a diagrammatic illustration of one embodiment of a system for measuring NOx content of exhaust gas produced by an internal combustion engine.

For the purposes of promoting an understanding of the principles of the invention, reference will now be made to a number of illustrative embodiments shown in the drawings and specific language will be used to describe the same. It will nevertheless be understood that no limitation of the scope of the invention is thereby intended.

Referring now to FIG. 1, a system 10 for measuring the NOx content of an exhaust gas includes an internal combustion engine 12 having an intake manifold 14 fluidly coupled to an intake conduit 16, and an exhaust manifold 18 fluidly coupled to an exhaust conduit 20. The system 10 may include a turbocharger as shown surrounded by a dash-lined perimeter 22 in FIG. 1. In embodiments of system 10 including turbocharger 22, a turbocharger compressor 24 includes a compressor inlet coupled to an intake conduit 26 for receiving fresh ambient air therefrom, and a compressor outlet fluidly coupled to intake conduit 16. Optionally, as shown in phantom in FIG. 1, the system 10 may include an intake air cooler 28 of known construction disposed in-line with the intake conduit 16. The turbocharger compressor 24 is mechanically coupled to a turbocharger turbine 30 via a drive shaft 32, wherein turbine 30 includes a turbine inlet fluidly coupled to exhaust conduit 20 and a turbine outlet fluidly coupled to ambient via an exhaust system 34.

The system 10 may also include an exhaust gas recirculation (EGR) system 36 shown in phantom in FIG. 1. The EGR system 36 includes an EGR valve 38 disposed in-line with an EGR conduit 40 fluidly connected between the exhaust conduit 20 and the intake conduit 16. An EGR outlet of the EGR valve 38 is fluidly coupled via conduit 40 to an inlet of an EGR cooler 42 having an outlet fluidly coupled to the intake conduit 16 via EGR conduit 40. The EGR cooler 42 is configured in a known manner to cool recirculated exhaust gas flowing therethrough. The EGR valve 38 is of known construction and is electronically controllable to selectively control the flow of recirculated exhaust gas therethrough to the intake manifold 14.

The system 10 includes a control computer 44 that is generally operable to control and manage the overall operation of the engine 12. Accordingly, the control computer 44 includes a number of inputs for receiving signals from various sensors or sensing systems associated with the system 10 and a number of outputs for controlling various operations of the system 10. For example, the control computer 44 receives data signals, such as engine speed data and engine temperature data, from various sensors, such as an engine speed sensor and an engine temperature sensor, via a number of signal paths 48. Additionally, the control computer 44 controls functions of the engine 12, such as throttle position and injection timing, via control signals transmitted via a number of the signal paths 48. For example, in systems 10 including an EGR system 36, the control computer 44 is operable to control the operation of the EGR valve 38 via an output signal path 50.

The control computer 44 is, in one embodiment, microprocessor-based and may be a known control unit sometimes referred to as an electronic or engine control module (ECM), electronic or engine control unit (ECU), or the like, or may alternatively be a general purpose control circuit capable of operation as will be described hereinafter. Accordingly, the control computer 42 may include any number of control algorithms, typically stored in a memory unit 46, for use in controlling and managing the overall operation of the engine 12.

The exhaust system 34 includes an exhaust pipe 52, an emission filter 54, and two NOx sensor arrangements 56. The filter 54 and arrangements 56 are fluidly coupled in-line with the exhaust pipe 52. One of the two NOx sensor arrangements 56 is positioned on each side of the emission filter 54. The emission filter 54 is of known construction and may be one of a number of types of emission filters such as a NOx adsorber filter, a particulate filter, and the like. In the system 10 illustrated in FIG. 1, one NOx sensor arrangement 56 is used to measure the NOx content of the exhaust gas produced by engine 12 before to the emission filter 54. The second NOx sensor arrangement 56 is used to measure the NOx content of the exhaust gas after the emission filter 54. The two NOx content values may be compared and the operation of system 10 may be modified accordingly. Alternatively, in other embodiments, a signal NOx sensor arrangement 56 may be used. In such embodiments, the single NOx sensor arrangement 56 may be positioned upstream of the emission filter, relative to the exhaust gas flow, to measure the NOx content of the exhaust gas prior to filtration by the emission filter 54. Alternatively, the single NOx sensor arrangement 56 may be positioned downstream of the emission filter, relative to the exhaust gas flow, to measure the NOx content of the exhaust gas after filtration by the emission filter 54.

The system 10 also includes a drive circuit 58 operable to control the NOx sensor arrangements 56. The drive circuit 58 is electrically coupled to the NOx sensor arrangements via a number of control signal paths $\mathbf{60}_{1-n}$ and to the control computer 44 via a number of control signal paths 64. The NOx sensor arrangements 56 receive power from a battery 67 or other power supply device via supply line 66. In one embodiment, the battery 67 is a vehicle battery used to supply power to the electrical components of a motor vehicle.

The drive circuit 58 produces control signals on paths $\mathbf{60}_{1-n}$ to control the operation of the NOx sensor arrangements 56 and receives control and/or data signals from the control computer on paths 64. NOx content data is provided to the control computer 44 by the NOx sensor arrangements 56 via communication link 62. In addition, the NOx sensor arrangements 56 receive control signals from the control computer 44 via the communication link 62. The communication link 62 may be any type of a communication link including serial or parallel data link using any one of a number of communications protocols. In the illustrative embodiment, the communication link 62 is a serial communication link having N signal paths, wherein N is a positive integer, configured as a Society of Automotive Engineers (SAE) J1939 hardware network configured for communications according to SAE J1939 communications protocol; however, other communication link configurations may be used. For example, the communication link 62 may be an SAE J1708 hardware network configured for communications according to SAE J1587 communications protocol, an RS-232 data link, a Universal Serial Bus (USB) communication link, or other type of communication link operable to connect the control computer 44 to the NOx sensor arrangements 56. Accordingly, the NOx sensor arrangements 56 include suitable electronics to communicate with the computer 44 via the communication link 62 using the determined communication protocol.

The drive circuit 58 allows selective measurement of the NOx content of the exhaust gas produced by the engine 12. The drive circuit 58 or the control computer 44 may determine when measurement of the NOx content of the exhaust gas is desirable or required based on one of a number of criteria such as engine operating condition data, elapsed time between measurements, triggering events, and the like. Although the drive circuit 58 is illustrated in FIG. 1 as a separate circuit from the control computer 44, the drive circuit 58 may be an internal sub-circuit of the control computer 44 in some embodiments. Alternatively, portions of the drive circuit 58 may be internal or external to the computer 44. For example, circuitry for determining the NOx content of the exhaust gas based off of the data signals received on paths 62 may be internal to the computer 44 whereas control circuitry, such as actuator driver circuitry, may be external to the computer 44.

Figure 2:
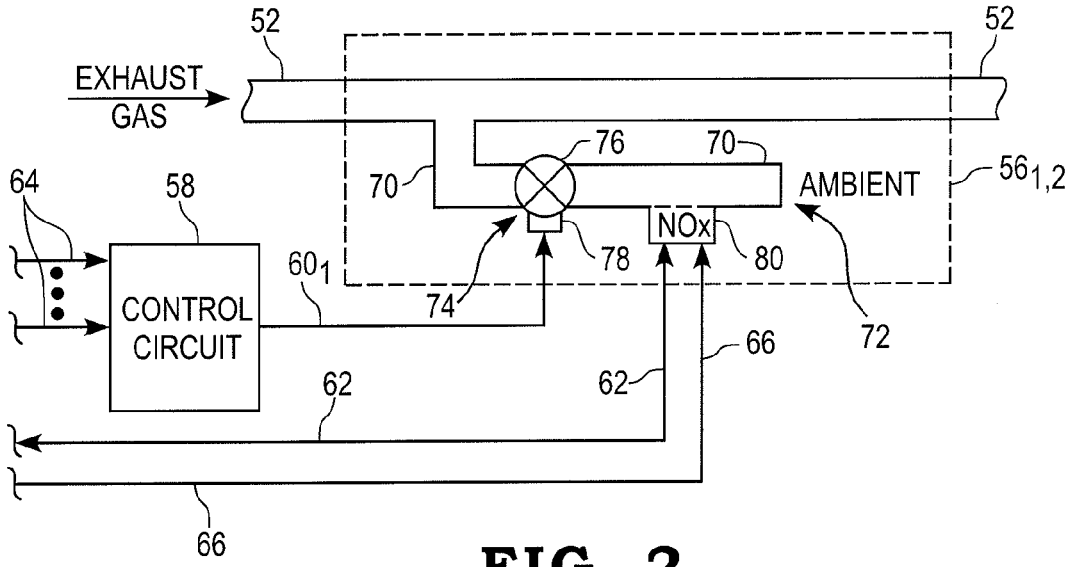
FIG. 2 is a diagram of one illustrative embodiment of either of the NOx sensor arrangements of the system of FIG. 1.

Referring now to FIG. 2, one illustrative embodiment of a NOx sensor arrangement $\mathbf{56}_{1,2}$ is shown. The arrangement $\mathbf{56}_{1,2}$ includes a bypass conduit 70 fluidly coupled at one end to the exhaust pipe 52. The bypass conduit 70 includes a second end 72 open to ambient air. The arrangement $\mathbf{56}_{1,2}$ also includes a valve 74 positioned in-line with the bypass conduit 70. The valve 74 includes a movable valve member 76 positioned within the conduit 70 and a motor 78 coupled to the valve member 76. The motor 78 is configured to control the movement or positioning of the valve member 76. Accordingly, the valve 74 is movable to an open position to allow exhaust gas to flow past the valve 74 or a closed position to restrict the flow of exhaust gas past the valve 74. The arrangement $\mathbf{56}_{1,2}$ further includes a NOx sensor 80 fluidly coupled to the bypass conduit 70 between the valve 74 and the open end 72 of the bypass conduit 70. It should be appreciated that when the valve 74 is in an open position exhaust gas is allowed to flow past the NOx sensor 80 and when the valve 74 is in a closed position the NOx sensor 80 is vented or otherwise exposed to ambient air via the second end 72 of the bypass conduit 70.

The drive circuit 58 is electrically coupled to the valve 74 via signal path $\mathbf{60}_1$ and is operable to control the positioning of the valve 74 (e.g., move the valve 74 to an open or closed position) via control signals produced on path $\mathbf{60}_1$. The NOx sensor 80 is coupled to the control computer 44 via the communication link 62 and to the battery 67 via supply line 66. When measurement of the NOx content of the exhaust gas is desired, the drive circuit 58 is operable to control the valve 74 to an open position and the control computer 44 is operable to receive data signals indicative of the NOx content of the exhaust gas from the NOx sensor 80 via the communication link 62. When measurement of the NOx content of the exhaust gas is not desired, the drive circuit 58 is operable to control the valve 74 to a closed position and the control computer 44 is operable to control the NOx sensor 80 to "power down" or otherwise inhibit power to or remove power from a sensing element (not shown) of the NOx sensor 80 via the communication link 62 so as to increase the usable life of the sensing element as is known in the art.

Figure 3:
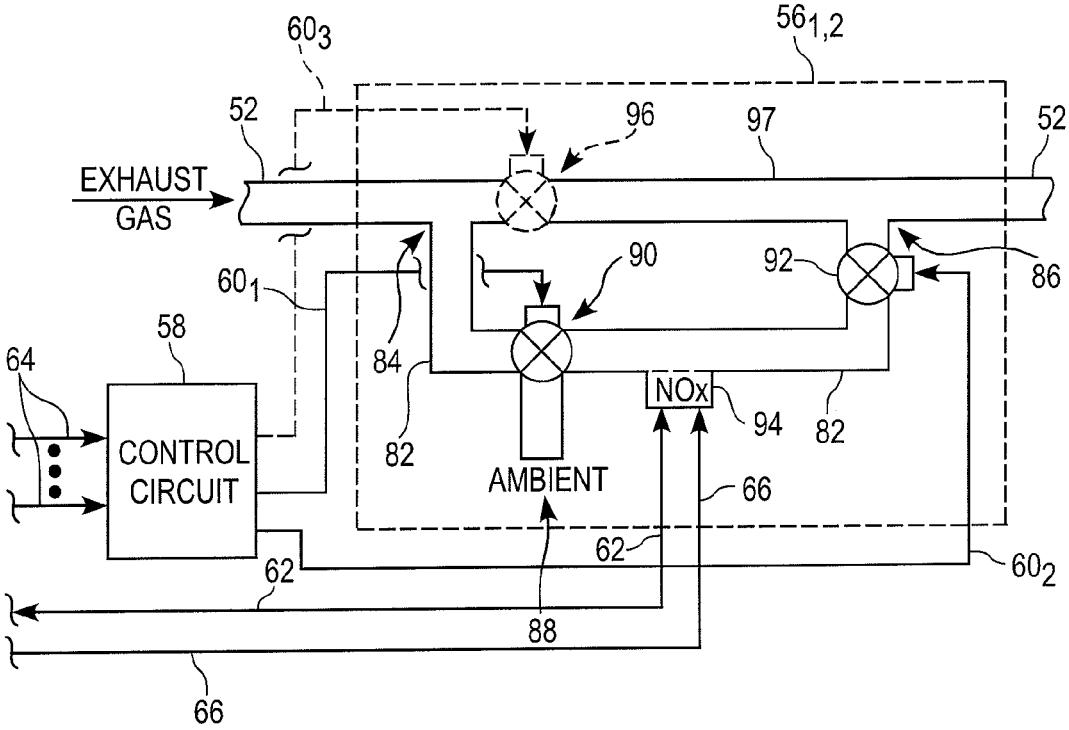
FIG. 3 is a diagram of an alternative illustrative embodiment of either of the sensor arrangements of FIG. 1.

Referring now to FIG. 3, another illustrative embodiment of a NOx sensor arrangement $\mathbf{56}_{1,2}$ is shown. The arrangement $\mathbf{56}_{1,2}$ includes a bypass conduit 82 fluidly coupled at a first end 84 to the exhaust pipe 52. The bypass conduit 82 also includes a second end 88 open to ambient air and a third end 86 also fluidly coupled to the exhaust pipe 52. The second end 88 of the bypass conduit 82 may be positioned anywhere along the bypass conduit 82 and is shown illustratively in FIG. 3 in a central location. Additionally, the second end 88 may be embodied as any opening, rather than an end, of the bypass conduit 82.

The NOx sensor arrangement $\mathbf{56}_{1,2}$ also includes a first valve 90 and a second valve 92 positioned in-line with the bypass conduit 82. The valves 90, 92 are substantially similar to the valve 74 of arrangement $\mathbf{56}_{1,2}$. The first valve 90 is positioned toward the first end 84 of bypass conduit 82 and in fluid communication with the second end 88. The second valve 92 is positioned toward the third end 86 of the bypass conduit 82. A NOx sensor 94 is fluidly coupled to the bypass conduit 82 between the first and second valves 90, 92.

Similar to the valve 74 of the NOx sensor arrangement $\mathbf{56}_{1,2}$, the valves 90, 92 are movable to open and closed positions. When the first and second valves 90, 92 are in open positions, exhaust gas is allowed to flow from the exhaust pipe 52 into the bypass conduit, past the first valve 90, past the NOx sensor 94, and past the second valve 92 back into the exhaust pipe 52. When the first and second valves 90, 92 are in closed positions, exhaust gas is inhibited from flowing past the valves 90, 92 and, accordingly, past the NOx sensor 94. The valves 90, 92 are typically moved to open and closed positions contemporaneously with each other to allow proper flowing of exhaust gas through the bypass conduit 82. It should be appreciated that when the first and second valves 90, 92 are in closed positions, the NOx sensor 94 is vented or otherwise exposed to ambient air via the open end 88 of the bypass conduit 82.

The drive circuit 58 is electrically coupled to the first and second valves 90, 92 via signal paths $\mathbf{60}_1$ and $\mathbf{60}_2$, respectively. The drive circuit 58 is operable to control the positioning of the valves 90, 92 (e.g., move the valves 90, 92 to open and closed positions) via control signals produced on the paths $\mathbf{60}_{1,2}$. In the embodiment of FIG. 3, the paths 60 are separate signal paths $\mathbf{60}_{1,2}$ coupled to separate outputs of the drive circuit 58. In alternative embodiments, the signal paths $\mathbf{60}_{1,2}$ may be electrically coupled together to a single output of the drive circuit 58. Accordingly, the control signals produced by the drive circuit 58 may be the same or different control signals.

The NOx sensor 94 is coupled to the control computer 44 via the communication link 62 and to the battery 67 via supply line 66. When measurement of the NOx content of the exhaust gas is desired, the drive circuit 58 is operable to control the valves 90, 92 to open positions and the control computer 44 is operable to receive data signals indicative of the NOx content of the exhaust gas from the NOx sensor 94 via the communication link 62. When measurement of the NOx content of the exhaust gas is not desired, the drive circuit 58 is operable to control the valves 90,92 to a closed position and the control computer 44 is operable to control the NOx sensor 94 to "power down" or otherwise inhibit power to or remove power from a sensing element (not shown) of the NOx sensor 94 via the communication link 62 so as to increase the usable life of the sensing element as is known in the art.

The drive circuit 58 is also electrically coupled to the NOx sensor 94 via signal path $\mathbf{62}_{1,2}$. When measurement of the NOx content of the exhaust gas is desired, the drive circuit 58 is operable to receive data signals indicative of the NOx content of the exhaust gas from the NOx sensor 94 via the path $\mathbf{62}_{1,2}$.

Referring still to FIG. 3, in an alternative embodiment, a third valve 96 may be coupled inline with the exhaust pipe 52 between the first and second ends 84, 86 of the bypass conduit 82. The third valve 96 is similar to the valve 76 of the NOx sensor arrangement $\mathbf{56}_{1,2}$ and is controllable to an open and closed position. When the third valve 96 is in an open position, exhaust gas is allowed to flow past the valve 96, through a portion 97 of the exhaust pipe 52, and subsequently through the remaining portion of the exhaust pipe 52. When the third valve 96 is in a closed position, exhaust gas is directed into the bypass conduit 82. Accordingly, in operation, the third valve 96 is moved to a closed position and the first and second valves 90, 92 are moved contemporaneously to open positions to direct substantially all the exhaust gas produced by the engine 12 into the bypass conduit 82 and past the NOx sensor 94 when measurement of the NOx content of the exhaust gas is desired. The positions of the valves 90, 92, 96 are subsequently reversed when measurement of the NOx content is completed. The valve 96 is controlled by the drive circuit 58 via signal path 60 similar to the first and second vales 90, 92.

Figure 4:
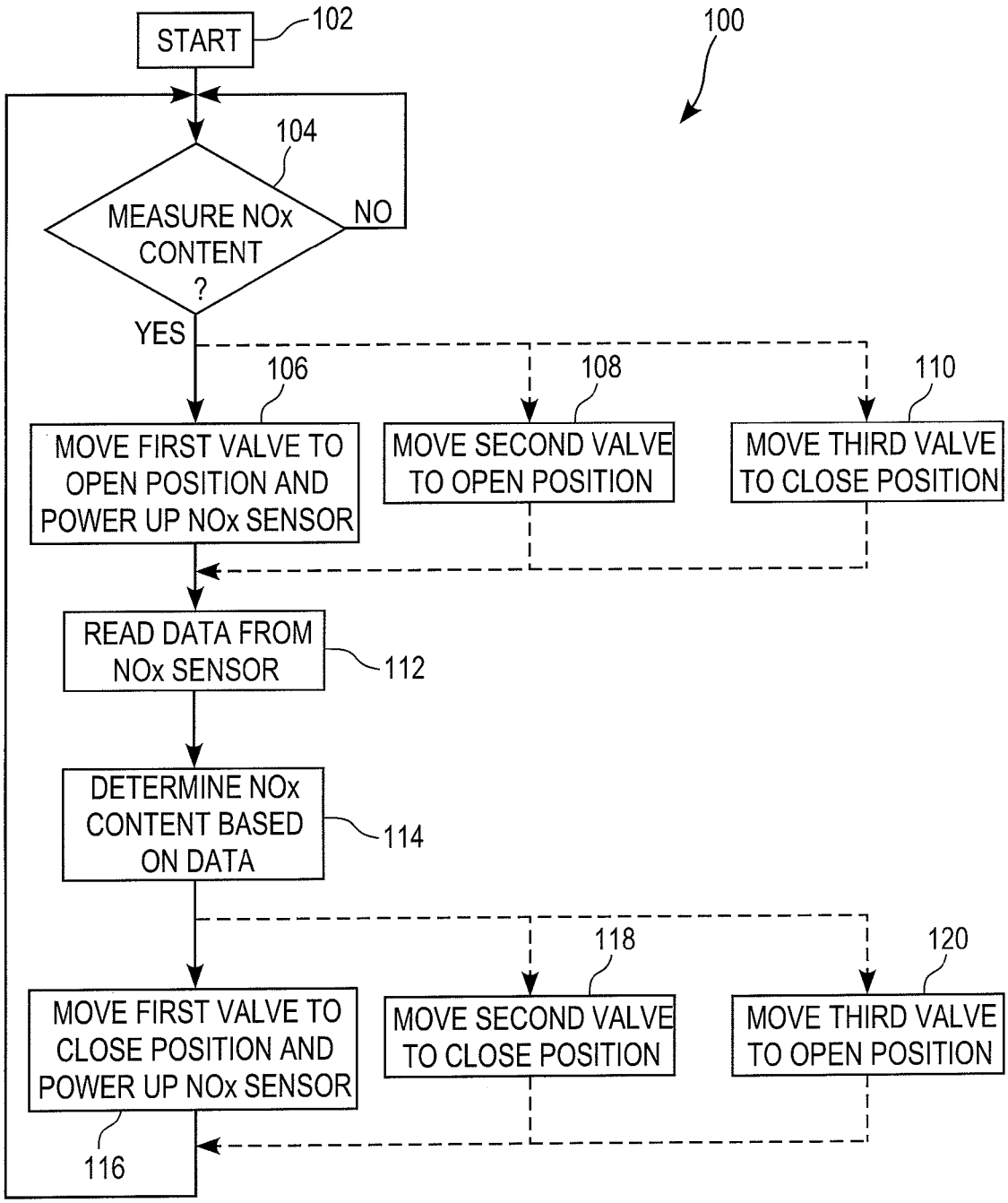
FIG. 4 is an flowchart of one illustrative embodiment of a software algorithm for measuring the NOx content of exhaust gas using the system illustrated in FIGS. 1-3.

Referring now to FIG. 4, a flowchart is shown illustrating one embodiment of a software algorithm 100 for measuring NOx content of exhaust gas produced by the engine 12. In one embodiment the algorithm 100 is stored in and executed by the control circuit 56. In other embodiments, the algorithm 100 may be stored within memory 46, and executed by control computer 44 in cooperation with the drive circuit 58. Regardless, the algorithm 100 will be described hereinafter with regard to drive circuit 58 with the understanding that some or all of the processing steps of the algorithm 100 may be performed by the control computer 44.

The control algorithm 100 begins at step 102, and thereafter at step 104 the drive circuit 58 is operable to determine if measurement of the NOx content of the exhaust gas produced by the engine 12 is desired. The determination of step 104 may be based on one or more criteria such as engine operating condition data, elapsed time between measurements, triggering events, and the like.

If measurement of the NOx content of the exhaust gas is desired, algorithm 100 advances to step 106 in which the drive circuit 58 is operable to control the first valve 76, 90 of the NOx sensor arrangement $\mathbf{56}_{1,2}$ to an open position. To do so, the drive circuit 58 produces appropriate control signals on the signal path $\mathbf{60}_{1\text{-}n}$ electrically coupled to the first valve 76, 90.

In addition, in step 106, the sensing element of the NOx sensor 80, 94 is "powered up" or otherwise supplied power. The sensing element may be powered up before, shortly after, or contemporaneously with the opening of the first valve 76, 90. Regardless, the sensing element of the NOx sensor 80,94 is powered up prior to the reading of the NOx content data (step 112) produced by the NOx sensor 80, 94 so as to provide accurate sensory data.

When the first valve 76, 90 is moved to an open position, exhaust gas is allowed to flow past the NOx sensor 80, 94. The first valve 76, 90 is maintained in an open position for a period of time appropriately long enough for the NOx sensor to produce an accurate data signal indicative of the NOx content of the exhaust gas. Illustratively, the first valve 76,90 is maintained in an open position for about three to five seconds, but may be maintained in an open position for a longer or shorter period of time depending upon the particular application.

In embodiments including a NOx sensor arrangement similar to arrangement 300, the algorithm 100 also advances to step 108 in which the drive circuit 58 is operable to control the second valve 92 to an open position via appropriate control signals produced on the signal path $\mathbf{60}_{1\text{-}n}$ electrically coupled to the second valve 92. In such embodiments, the process steps 106 and 108 are typically performed in parallel and contemporaneously with each other. Accordingly, the first and second valves 90, 92 are moved substantially in unison with each other to open positions and maintained in open positions for a period of time appropriately long enough for the NOx sensor to produce an accurate data signal (e.g., three to five seconds).

In embodiments of the NOx sensor arrangement including a third valve 96, the algorithm 100 also advances to step 110 in which the drive circuit 58 is operable to control the third valve 92 to a closed position via appropriate control signals produced on the signal path $\mathbf{60}_{1\text{-}n}$ electrically coupled to the third valve 96. In such embodiments, the process steps 106, 108, and 110 are typically performed in parallel and contemporaneously with each other. Accordingly, the first and second valves 90, 92 and the third valve 96 are moved substantially in unison with each other to open and closed positions, respectively. When the valves 90, 92, 96 are so positioned, substantially all the exhaust gas produced by the engine 12 is directed into the bypass conduit 82 and across the NOx sensor 94. The valves 90, 92, 96 are maintained in their respective positions for a period of time appropriately long enough for the NOx sensor to produce an accurate data signal indicative of the NOx content of the exhaust gas (e.g., three to five seconds).

Due to the positioning of the valves 76, 90, 92, 96 in process steps 106,108, and 110, exhaust gas is diverted across the NOx sensor 80, 94. The NOx sensor 80,94 produces a data signal indicative of the NOx content of the exhaust gas flowing thereby. In process step 112, the drive circuit 58 is operable to read the data signal produced by the NOx sensor 80, 94 via signal path 62. The algorithm 100 then advances to step 114 in which the drive circuit 58 is operable to determine the NOx content based on the data signal from the NOx sensor 80, 94. The drive circuit 58 may used known methods to determine the NOx content based on the data signal. For example, if the data signal is a voltage dependant data signal, the drive circuit 58 may be operable to convert the voltage of the data signal to a NOx content value. In some embodiments, the NOx content value and/or the data signal is provided to the control computer 44 via the signal path 66. The control computer 44 may be operable to alter the operation of the engine 12 or system 10 based on the NOx content value or data signal. In other embodiments, the drive circuit 58 may be operable to alter the operation of the engine 12 or system 10 based on the NOx content value or data signal.

Once the drive circuit 58 has determined the NOx content of the exhaust gas flowing past the NOx sensor 80, 94, the algorithm 100 advances to step 116 in which the drive circuit 58 is operable to control the first valve 76, 90 of NOx sensor arrangement 200, 300 to a closed position. To do so, the drive circuit 58 produces appropriate control signals on the signal path $\mathbf{60}_{1\text{-}n}$ electrically coupled to the first valve 76, 90. In step 116, the control computer 44 inhibits power to the sensing element of the NOx sensor 80, 94 via communication link 62 so as to "power down" or otherwise remove power from the sensing element. Powering down the sensing element when NOx content data is not desired increases the usable life of the NOx sensor. In addition, when the first valve 76, 90 is moved to a closed position, exhaust gas is inhibited from flowing past the NOx sensor 80, 94 and the NOx sensor 80, 94 is vented or otherwise exposed to ambient air so as to further increase the usable life of the NOx sensor.

In embodiments including a NOx sensor arrangement similar to arrangement 300, the algorithm 100 also advances to step 118 in which the drive circuit 58 is operable to control the second valve 92 to a closed position. In such embodiments, the process steps 116 and 118 are typically performed in parallel and contemporaneously with each other. Accordingly, the first and second valves 90, 92 are moved substantially in unison with each other to closed positions.

In embodiments of the NOx sensor arrangement including a third valve 96, the algorithm 100 also advances to step 120 in which the drive circuit 58 is operable to control the third valve 92 to an open position. In such embodiments, the process steps 116, 118, and 120 are typically performed in parallel and contemporaneously with each other. Accordingly, the first and second valves 90, 92 and the third valve 96 are moved substantially in unison with each other to closed and open positions respectively. When the valves 90, 92, 96 are so positioned, substantially all the exhaust gas produced by the engine 12 is directed through the exhaust gas pipe 52.

After execution of step 116, the algorithm 100 loops to step 104 in which the drive circuit 58 is again operable to determine if measurement of the NOx content is desirable. If so, the algorithm 100 repeats steps 106-120.

While the system and method for measuring a NOx content of an exhaust gas has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. For example, while the system and method for measuring NOx content of an exhaust gas has been described in the context of an exhaust system of an internal combustion engine, it is believed the invention is applicable to other applications to selectively route gases to various types of sensors.

What is claimed is:

1. A system for measuring NOx content of exhaust gas produced by an internal combustion engine, the system comprising:

a bypass conduit having a first end fluidly coupled to an exhaust pipe of the engine, a second end open to ambient air and a third end fluidly coupled to the exhaust pipe downstream, relative to the exhaust pipe, of a junction of the exhaust pipe with the first end of the bypass conduit, with the second end of the bypass conduit open to ambient air between the first and third ends;

a first valve positioned in-line with the bypass conduit;

a second valve positioned inline with the bypass conduit;

a NOx sensor fluidly coupled to the bypass conduit between the first and second valves, the NOx sensor producing a NOx signal indicative of a NOx content of exhaust gas flowing thereby; and a control circuit controlling the first valve to an open position to allow exhaust gas to flow past the NOx sensor when measurement of the NOx content is desired, and otherwise controlling the valve to a closed position to inhibit exhaust gas flow past the NOx sensor.

2. The system of claim 1, wherein the first valve is positioned between the first end and the NOx sensor.

3. The system of claim 1, wherein the first valve is operable in its open position to allow exhaust gas to flow through the open bypass conduit and past the NOx sensor while inhibiting flow of the exhaust gas out of the second end, and the first valve is operable in its closed position to inhibit exhaust gas flow past the NOx sensor while exposing the NOx sensor to ambient air via the second end of the bypass conduit.

4. The system of claim 1, wherein the control circuit includes a control circuit controlling the first and second valves to open positions to allow exhaust gas to flow past the NOx sensor when measurement of the NOx content is desired, and otherwise controlling the first and second valves to closed positions to inhibit exhaust gas flow past the NOx sensor.

5. The system of claim 1, further comprising a third valve positioned in-line with the exhaust pipe downstream relative to the exhaust pipe of a junction of the exhaust pipe with the first end of the bypass conduit and upstream of a junction of the exhaust pipe with the second bend of the bypass conduit.

6. The system of claim 5, wherein the control circuit is configured to control the third valve to a closed position to direct the exhaust gas into the bypass conduit when measurement of the NOx content is desired, and otherwise to control the third valve to an open position.

7. The system of claim 6, wherein the NOx sensor is exposed to ambient air when the first valve is in the closed position.

8. An exhaust system of an internal combustion engine, the exhaust system comprising:

an exhaust pipe fluidly coupled to the engine;

an emissions filter coupled in-line with the exhaust pipe;

a NOx sensor arrangement in fluid communication with the exhaust pipe, the NOx sensor arrangement having a NOx sensor and a first controllable valve movable between a closed position and an open position, wherein the NOx sensor arrangement includes a bypass conduit having one end fluidly coupled to the exhaust pipe, a second end open to ambient air and a third end fluidly coupled to the exhaust pipe downstream, relative to the exhaust pipe, of a junction of the exhaust pipe with the first end of the bypass conduit, with the second end of the bypass conduit open to ambient air between the first and third ends, and wherein the first valve is positioned in-line with the bypass conduit, and wherein the first NOx sensor arrangement includes a second controllable valve movable between a closed position and an open position, the second valve positioned inline with the bypass conduit, the NOx sensor fluidly coupled to the bypass conduit between the first and second valves; and a control circuit configured to control the first valve between the closed position to inhibit a flow of exhaust gas from the engine to the NOx sensor and the open position to direct at least a portion of the flow of the exhaust gas to the NOx sensor.

9. The exhaust system of claim 8 wherein the NOx sensor is exposed to ambient air when the first valve is in the closed position.

10. The exhaust system of claim 8, wherein the control circuit is configured to control the position of the first and second valves between the closed positions to inhibit a flow of exhaust gas to the NOx sensor and the open positions to direct at least a portion of the flow of the exhaust gas to the NOx sensor.

11. The exhaust system of claim 8, wherein the NOx sensor arrangement includes a third valve movable between a closed position and an open position, the third valve positioned inline with the exhaust pipe.

12. The exhaust system of claim 11, wherein the control circuit is configured to control the position of the third valve between the closed and open positions.

13. The exhaust system of claim 12, wherein the NOx sensor is exposed to ambient air when the first valve is in the closed position.

14. A method of measuring a NOx content of exhaust gas produced by an internal combustion engine, the method comprising:

moving a first valve to an open position to allow exhaust gas to flow past a NOx sensor when measurement of the NOx content is desired;

moving the first valve to a closed position to inhibit exhaust gas flow past the NOx sensor;

processing a data signal produced by the NOx sensor only when the first valve is in the open position to determine the NOx content of the exhaust gas;

moving a second valve to an open position to allow the exhaust gas flowing past the NOx sensor to flow into an exhaust pipe of the engine when measurement of the NOx content is desired; and moving the second valve to a closed position subsequent to the processing step.

15. The method of claim 14, further comprising moving a third valve to a closed position to inhibit exhaust gas flow through a portion of the exhaust pipe when measurement of the NOx content is desired; and moving the third valve to an open position to allow exhaust gas flow through the portion of the exhaust pipe.

16. A method of routing a flow of exhaust gas produced by an internal combustion engine to a NOx sensor, the method comprising:

controlling a first valve to an open position to direct at least a portion of the flow of exhaust gas to the NOx sensor;

controlling the first valve to a closed position to inhibit the flow of exhaust gas to the NOx sensor;

moving a second valve to an open position to direct the flow of exhaust gas flowing to the NOx sensor to an exhaust pipe; and controlling the second valve to a closed position to inhibit the flow of exhaust gas to the NOx sensor.

17. The method of claim 16, further comprising moving a third valve to a closed position to direct the flow of exhaust gas to the NOx sensor; and controlling the third valve to an open position to direct the flow of exhaust gas away from the NOx sensor.

* * * * *